US005077990A

United States Patent [19]

Plath

[11] Patent Number: 5,077,990

[45] Date of Patent: Jan. 7, 1992

[54] KNITTING MACHINE AND PARTS HAVING DIAMOND-LIKE CARBON COATED SURFACES

[75] Inventor: Ernst-Dieter Plath, Albstadt, Fed. Rep. of Germany

[73] Assignee: Sipra Patententwicklungs-und Beteiligungsgesellschaft mbH, Albstadt, Fed. Rep. of Germany

[21] Appl. No.: 348,195

[22] Filed: Jul. 19, 1989

[30] Foreign Application Priority Data

May 6, 1988 [DE] Fed. Rep. of Germany ..... 3815457

[51] Int. Cl.[5] ..... D04B 15/00

[52] U.S. Cl. ..... 66/123

[58] Field of Search ..... 66/115, 123, 120, 124

[56] References Cited

U.S. PATENT DOCUMENTS

| | | | |
|---|---|---|---|
| 3,699,784 | 10/1972 | Berentzen | 66/123 |
| 3,882,695 | 5/1975 | Flicker | 66/115 |
| 3,964,274 | 6/1976 | Stivers et al. | 66/123 |
| 4,434,628 | 3/1984 | Tsuzuki | 66/123 |

FOREIGN PATENT DOCUMENTS

| | | |
|---|---|---|
| 3047888 | 7/1982 | Fed. Rep. of Germany . |
| 3237851 | 4/1983 | Fed. Rep. of Germany . |
| 3703078 | 8/1987 | Fed. Rep. of Germany . |
| 0118694 | 6/1985 | Japan . |
| 1106494 | 5/1986 | Japan . |
| 85275 | 3/1986 | PCT Int'l Appl. . |
| 1049691 | 11/1966 | United Kingdom . |
| 1347272 | 2/1974 | United Kingdom . |

OTHER PUBLICATIONS

Growth of Diamond Thin Films by Electron-Assisted Chemical Vapor Desposition, A. Sawabe and T. Inuzuka, 10-1984.

*Primary Examiner*—Werner H. Schroeder
*Assistant Examiner*—John J. Calvert
*Attorney, Agent, or Firm*—Michael J. Striker

[57] ABSTRACT

The knitting machine has knitting elements including needles, sinkers, and the like and guide parts for the knitting elements, including cam parts, guide tricks and the like, these groups of parts moving relative to each other and being provided with mutually contacting sliding surfaces or faces. To reduce heating during operation, the need for auxiliary lubricating devices, and to lower power requirements during operation the opposing sliding surface or faces of the moving parts of the knitting machine are at least partially provided with a friction-reducing and wear-resistant coating of diamond-like carbon. This coating is applied by a plasma CVD process (FIG. 3).

9 Claims, 3 Drawing Sheets

14·2
12
16
24
15
11
13 14
18
14·1
10
17
19
13

KNITTING MACHINE AND PARTS HAVING DIAMOND-LIKE CARBON COATED SURFACES

THE BACKGROUND OF THE INVENTION

This invention relates to a knitting machine with a first group of parts in the form of knitting elements, such as needles, sinkers, jacks or the like and with a second group of parts in the form of guide elements, such as cam parts, needle bed or sinker bed bars or walls or the like. These parts move in relation to each other in operation and their faces slide on each other. Because of that their faces or surfaces which contact each other are formed at least partially as wear-resistant surfaces to enhance the resistance to abrasion.

Knitting machines which contain parts of the first and second groups provided with low-wear surfaces are already known in various forms (DE-GM 1 647 894, DE-GM 7 147 560, DE-OS 2 118 624, DE-OS 2 251 799). The surfaces can consist in particular of tungsten carbide, metal-ceramic material, chromium oxide, synthetic gems or the like or can be produced simply by the use of adequately hardened materials and are as a rule specially matched to the relevant part of the first or second group.

In these current knitting machines the aim has always and exclusively been to obtain through a high hardness of the contacting surfaces of the parts of the machine a long service life of the parts and hence of the knitting machine as a whole.

SUMMARY OF THE INVENTION

In contrast to this the invention has the object of providing contacting surfaces or faces on parts of a knitting machine which move relative to each other in operation, which, not only increase the service life on account of their hardness but also at the same time provide a substantial improvement of the sliding characteristics as a result of a reduction of the sliding or frictional resistance between the parts of the first and second groups. By reducing the friction between the surfaces the drive load and the heating up of the knitting machine is greatly reduced.

It is another object of the present invention to provide a friction-reducing and low-wear surface which can be applied in substantially the same manner to all parts of the first and second groups, so that production costs are not increased by surfaces which must be individually matched.

According to the invention contacting faces or surfaces of the parts, which move relative to each other, are at least partially formed as wear-resistant and also friction-reducing surfaces. The faces or surfaces which are wear-resistant and friction-reducing are provided with a friction-reducing coating of diamond-like carbon applied by plasma discharge in a carbon-containing gaseous atmosphere.

Because of the improvement provided by the improved contacting surfaces or faces of the knitting machine parts, there is a substantial reduction of sliding resistance as well as an adequate hardness. Further both parts of a pair of parts which contact each other and slide on each other can be provided with the same coating which is even more favorable for reduction of wear and frictional resistance. Thus the same production methods apply to all parts which simplifies their manufacture.

A particular advantage of the invention, not previously attained in knitting machines, is that, because of the reduced friction between the parts, on the one hand, the need for special cooling devices, expensive lubricating systems, or similar devices to keep the generation of heat within reasonable bounds, especially in high capacity machines, is avoided or at least markedly reduced, and, on the other hand, knitting speeds and a higher number of systems become possible, because the parts of the first group run more easily and steeper cam curves can be provided, especially in the region of the loop forming operation.

An additional advantage of the invention is that knitwear produced on the knitting machine is less soiled, because less worn off metal and lubricating oil can be deposited on the knit product. These advantages arise even if only the first group of parts, i.e. needles, jacks, sinkers, or the like, are provided with the friction-reducing and low-wear coating, so that the advantages of the coating with diamond-like carbon can be enjoyed also with knitting machines already in operation. Naturally the aforesaid advantages are particularly noticeable when all parts of the first and second groups sliding on one another are provided with the coating according to the invention. Since the coating is very resistant to abrasion, coatings with a thickness of less than 5$\mu$ are sufficient. The amorphous structure of the diamond-like carbon coating begins to be lost at temperatures above about 400°. However this is a temperature range which is not attained in knitting machines with the aforementioned parts movable relative to one another and sliding on one another, even in high capacity operation.

Coatings of diamond-like carbon are applied in a manner known per se by plasma discharge in a carbon-containing gaseous atmosphere (DE-OS 3 237 851, DE-OS 3 703 078, DE-PS 3 047 888).

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE INVENTION

Figure 1:
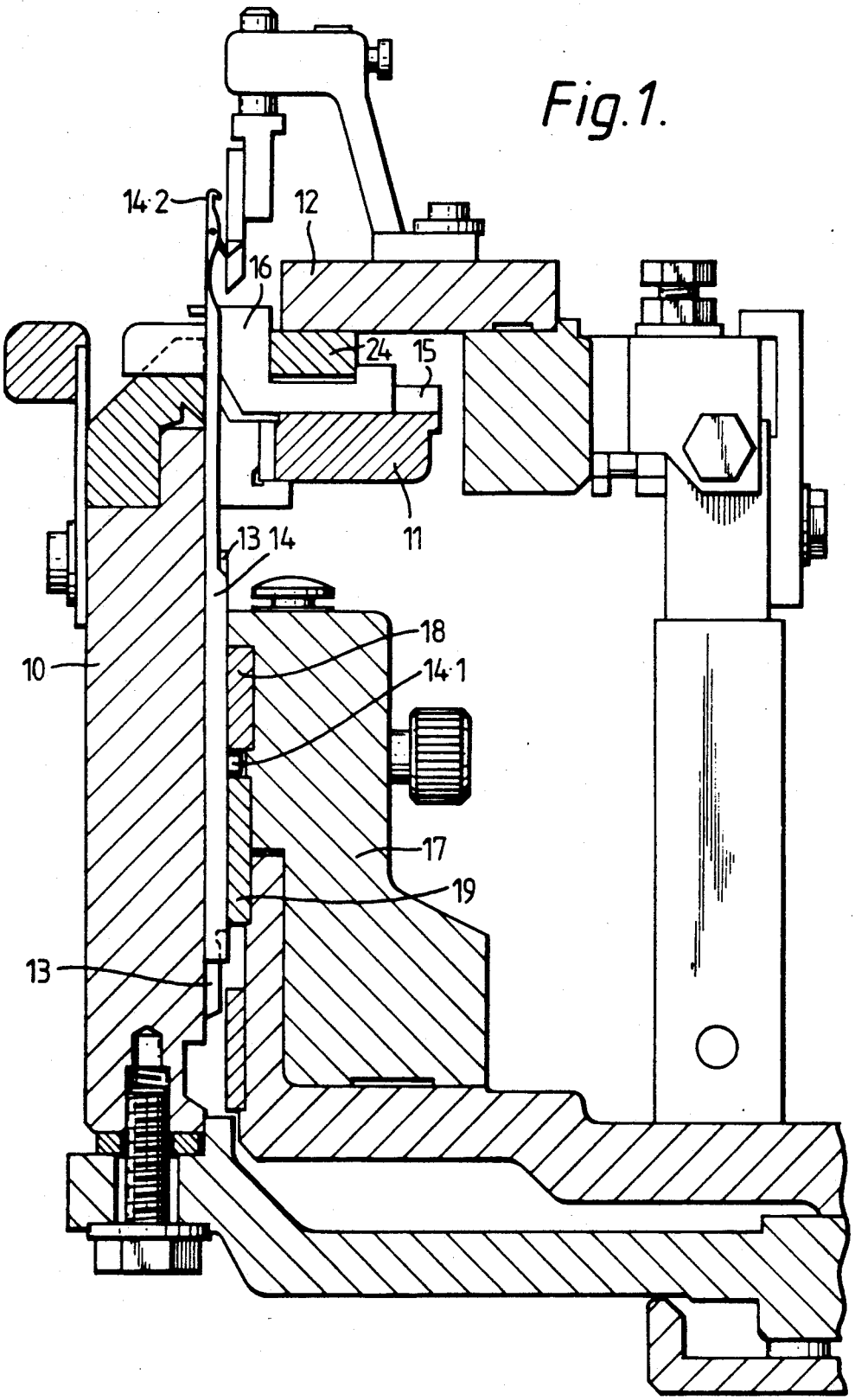
FIG. 1 is a schematic radial cross sectional view through a circular knitting machine.
Figure 2:
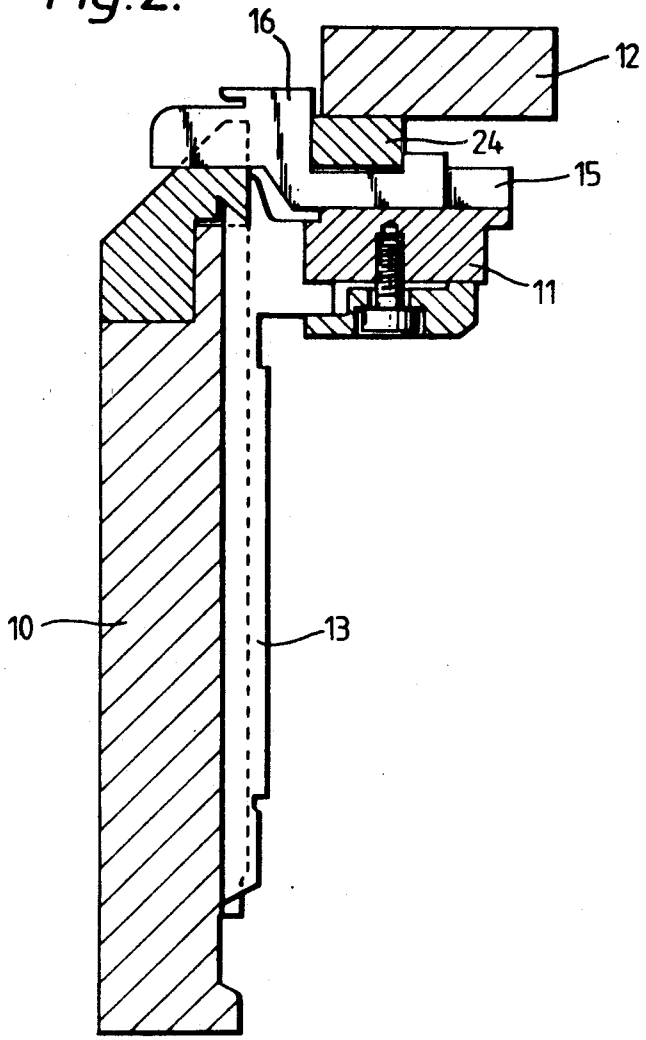
FIG. 2 is a partial cross sectional view through the circular knitting machine of FIG. 1 simplified.
Figure 4:
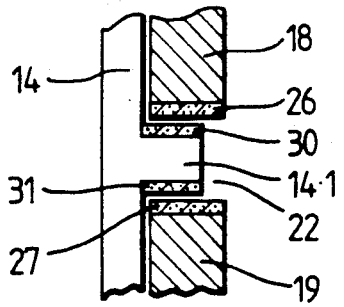
Figure 5:
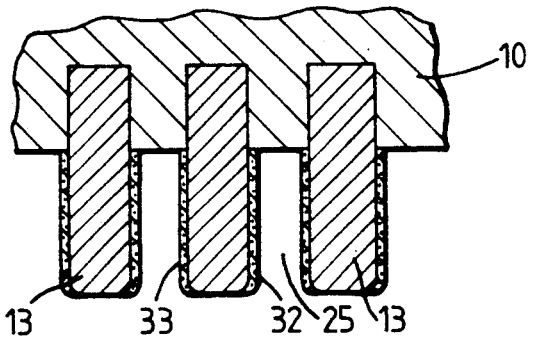
Figure 6:
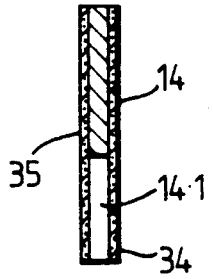
Figure 7:
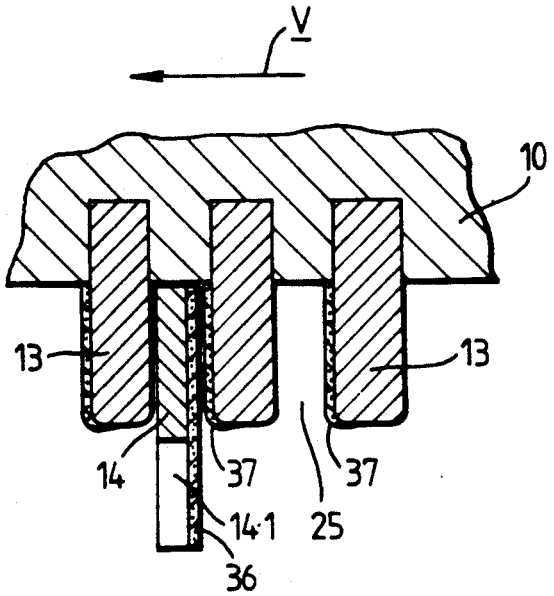

FIGS. 1 and 2 show in radial section a needle cylinder 10, a sinker ring 11 and a sinker cam ring 12 of a circular knitting machine. On the outer periphery of the needle cylinder 10 there are fitted bars or walls 13, uniformly spaced and extending parallel to each other in the cylinder longitudinal direction, which form guide tricks for the needles 14 shown in FIGS. 1 and 3. Similar bars 15 are provided in the sinker ring 11 to delimit guide tricks for sinkers 16, which can be the usual holding down and knock-over sinkers.

In FIG. 1 a cylinder cam ring 17 is also shown. The sinker cam ring 12 and the cylinder cam ring 17 are stationary, while the needle cylinder 10 and the sinker ring 11 are mounted rotatably and turn during operation of the circular knitting machine, although the mechanism can be designed to operate in the reverse fashion.

Figure 3:
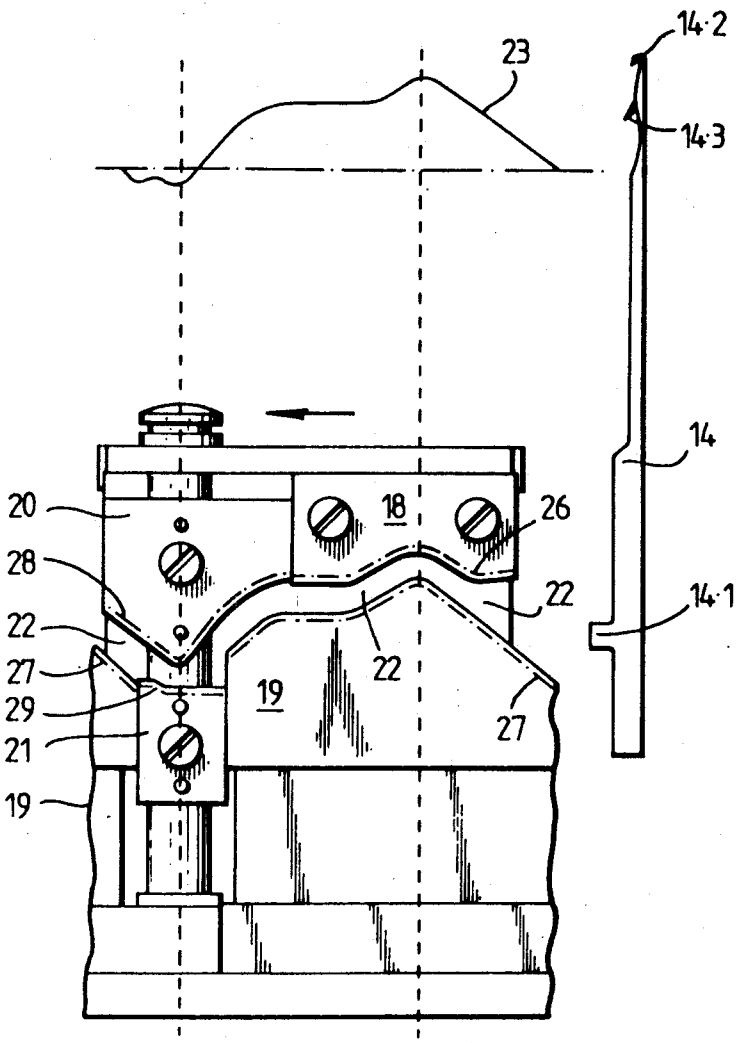
FIG. 3 is a schematic plan view of cam parts of of a first group of parts of a circular knitting machine according to FIGS. 1 and 2.

The cylinder cam ring 17 is equipped with plate-formed cam parts 18, 19, 20, 21, which are shown in FIG. 3 in plan view and define a cam channel 22 for a drive butt 14.1 of the needles 14. By means of the stationary cam channel 22 the needles 14 moved together with the needle cylinder 10 are moved longitudinally in a known manner so that their needle heads 14.2 describe a needle curve 23 shown in FIG. 3. In FIG. 3 there is moreover shown a needle latch 14.3. The sinker cam ring 12 is provided with cam parts 24 for a longitudinal movement of the sinkers 16.

The needles 14, which can be replaced by compound needles, the sinkers 16 and jacks, not shown but known to one skilled in the art and provided for pattern-dependent selection of needles, are knitting elements which form a first group of parts, which are mounted movably in the guide tricks formed by the bars 13 and 15 and which can move therein up and down, to and fro or radially, depending on the type of the knitting machine. The bars 13 and 15 and the cam parts 18 to 21 and 24 on the other hand represent a second group of parts in the form of guide elements for the first group of parts and are mounted fixedly or movably, in according with whether the needle cylinder 10 and the sinker ring 12 are rotated and the cam rings 12, 17 are stationary or vice versa. In accordance with this structure and mechanism which is known in the art, the various parts undergo numerous movements during operation of the machine and the first group of parts slide along one another (e.g. when two sinkers are arranged alongside each other in one trick or compound needles are used) or on the associated surfaces of the second group of parts. It is self evident to one skilled in the art that the surfaces or faces which slide on each other can be narrow up to the point of being more or less sharp edges.

Of the parts moving relative to one another and in sliding contact with each other, the needles 14, sinkers 16 and the like serving as knitting elements are provided with a thin coating or layer of diamond-like carbon, preferably over the whole outer surface. By means of this low abrasion and wear-resistant coating or layer the coefficient of friction of the knitting elements relative to the bars 13, 15 of the needle cylinder 10 and the sinker ring 11, of the surfaces which can slide on one another, as well as the cam parts 19 to 21 and 24, is at the same time strongly reduced. In the case of the needles 14 or other needles, through the coating of the needle head 14.2 and the needle latch 14.3 and including their mounting region, the wear of these parts by mutual contact and by contact with the yarn engaged by the needle head 14.2 is also reduced. The easy operation of the knitting elements can be further enhanced in the parts of the second group by providing them with a coating of diamond-like carbon, at least one their faces and edges which contact the knitting elements.

According to the kind of use and the knitting machine type it is possible in this way by coating all or only some critical regions of the faces or edges of the surfaces or faces contacting each other on parts sliding on each other to achieve a substantial reduction of the total frictional forces arising in operation of the knitting machine. Furthermore the hardness of the participating parts of conventional construction is increased about four-fold by the coating of diamond-like carbon and at the same time the coefficient of friction can fall by about a factor of 7.5.

The invention is not restricted to the above described embodiment and can be modified in numerous ways. Instead of the sinker ring arrangement a dial arrangement can be provided for example. Instead of a circular knitting machine the knitting machine can be another kind of knitting machine, especially a flat knitting machine. Furthermore it is possible to coat only selected parts of the first and second groups, e.g. the needles 14 and the bars 13, since a coating of these parts leads, depending on the particular case, to the desired overall reduction of friction.

An embodiment of such coatings is shown in FIG. 3.

FIG. 3 shows coatings 26, 27, 28 and 29 for the lock parts 18, 19, 20 and 21, which are provided on the surfaces bordering the lock channel 22, along which the drive butts 14.1 slide in operation. It is apparent that the upper and lower edges of the drive butts 14.1 coming into contact with the coatings 26 to 29 are preferably also provided with such coatings.

Coating of the needles and bars on both sides is advantageous above all when the respective needle bed or correspondingly the cam ring can also be moved in the opposite direction as is the case for example with circular knitting machines with means for reciprocating rotary movement of the needle cylinder 10 and the sinker ring 11 or with flat knitting machines. This applies correspondingly in the use of sinkers, jacks or the like instead of needles.

Although it can suffice only to provide some preferential surfaces or edges of the parts of the first and/or second groups with coatings according to the invention, in the preferred embodiment at present all sliding surfaces are coated.

The diamond-like carbon coating of the invention is produced by the method previously mentioned. According to this method the coating is produced in an evacuated chamber, in which a carbon-containing gas, e.g. acetylene, is introduced. Then a plasma discharge is initiated in the gas at reduced pressure. This method is referred to as a CVD process(CVD=chemical vapor deposition). The coating is deposited by a chemical reaction from the gas phase. The carbon is deposited on the surface of the part in this way. The heating of the parts is so low that it is possible to coat high alloy steel without it losing its hardness and even paper. The thickness of the finally obtained surface layer or coating is dependent on the dwell time in the chamber in which the plasma is produced. Surface coating thicknesses of up to $5\mu$ (micrometers) are produced depending on the dwell time. The apparatus required for the use of this method consists of a chamber for receiving the gas mixture in question at a defined pressure and a device for producing a high frequency electromagnetic discharge in the megahertz range with a suitable power.

It will be understood that each of the elements described above, or two or more together, may also find a useful application in other types of structures differing from the types described above.

While the invention has been illustrated and embodied in a knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

1. In a knitting machine with a first group of parts in the form of knitting elements including at least one member selected from the group consisting of needles, sinkers and jacks and with a second group of parts in the form of guide elements including at least one member selected from the group consisting of cam parts, needle bed and sinker bed walls, wherein said first and second groups of parts have mutually contacting sliding faces and undergo relative movement in operation and thus slide with sliding faces on one another, said faces being at least partially formed as rear-resistant faces, the improvement wherein said faces are also at least partially formed as rear-resistant and also friction-reducing surfaces, and said faces which are wear-resistant and friction-reducing are provided with a friction-reducing coating of diamond-like carbon applied by plasma discharge in a carbon-containing gaseous atmosphere.

2. The improvement as defined in claim 1, wherein the parts of the first group are provided with the wear-resistant and friction-reducing coating.

3. The improvement as defined in claim 2, wherein the parts of the first group consist of needles (14) having heads and said needles are provided with the wear-resistant and friction-reducing coating in the vicinity of said heads (14.2).

4. The improvement as defined in claim 2, wherein the parts of the first group consist of needles (14) with associated latches and latch mounting places and said needles are provided with the wear-resistant and friction-reducing coating in the vicinity of said latches (14.3) and latch mounting places.

5. The improvement as defined in claim 1, wherein the parts of the second group are provided with the wear-resistant and friction-reducing coating.

6. The improvement as defined in claim 5, further comprising a plurality of guideways (22) for the parts of the first group, said guideways being formed from a plurality of cam parts (18 to 21, 24) with guideway surfaces, said guideway surfaces defining the guideway and being provided with the wear-resistant and friction-reducing coating (26–29).

7. The improvement as defined in claim 5, further comprising at least one bed (10, 11) with guide tricks (25) for the parts of the first group, said guide tricks (25) being defined by bars (13,15) with lateral sliding surfaces, and the lateral sliding surfaces of the bars (13, 15) being provided with the wear-resistant and friction-reducing coating.

8. The improvement as defined in claim 7, wherein the complete surface of the guide tricks are provided with the wear-resistant and friction-reducing coating.

9. The improvement as defined in claim 1, wherein the wear-resistant and friction-reducing coating has a thickness of at most 5μ (micrometers).

* * * * *